United States Patent [19]

Ibbott

[11] Patent Number: 4,569,684

[45] Date of Patent: Feb. 11, 1986

[54] ELECTROSTATIC AIR CLEANER

[76] Inventor: Jack K. Ibbott, 17-7 Nishiazabu 4-chome, Minato-ku, Tokyo 106, Japan

[21] Appl. No.: 486,282

[22] PCT Filed: Jul. 29, 1982

[86] PCT No.: PCT/JP82/00295

§ 371 Date: Mar. 30, 1983

§ 102(e) Date: Mar. 30, 1983

[87] PCT Pub. No.: WO83/00450

PCT Pub. Date: Feb. 17, 1983

[30] Foreign Application Priority Data

Jul. 31, 1981 [JP] Japan ..... 56-119372

[51] Int. Cl.[4] ..... B03C 3/08; B03C 3/60

[52] U.S. Cl. ..... 55/138; 55/142; 55/143; 55/145; 55/146; 55/155; 55/156; 55/157

[58] Field of Search ..... 55/130, 131, 138, 142, 55/143, 145, 146, 150, 154, 155, 157; 361/231

[56] References Cited

U.S. PATENT DOCUMENTS

| | | | |
|---|---|---|---|
| 1,541,704 | 6/1925 | Gies | 55/130 |
| 2,277,712 | 3/1942 | Otto | 55/150 |
| 2,789,658 | 4/1957 | Wintermute | 55/138 |
| 2,822,057 | 2/1958 | Richardson | 55/143 |
| 3,406,669 | 10/1968 | Edwards | 55/138 |
| 3,461,882 | 8/1969 | Epstein et al. | 55/142 |
| 3,594,989 | 7/1971 | Bastiaans | 55/142 |
| 4,077,782 | 3/1978 | Drummond et al. | 55/155 |
| 4,109,290 | 8/1978 | Gallagher | 55/150 |
| 4,166,729 | 9/1979 | Thompson et al. | 55/143 |
| 4,177,047 | 12/1979 | Goland | 55/146 |
| 4,354,861 | 10/1982 | Kalt | 55/130 |

FOREIGN PATENT DOCUMENTS

| | | | |
|---|---|---|---|
| 38879 | 12/1970 | Japan | 55/154 |
| 142800 | 11/1980 | Japan | 55/154 |
| 895024 | 4/1962 | United Kingdom | 55/155 |

*Primary Examiner*—David L. Lacey

*Attorney, Agent, or Firm*—Wenderoth, Lind & Ponack

[57] ABSTRACT

An electrostatic air cleaner includes positive and negative plates disposed alternately at predetermined intervals. Each electrode plate is formed by a plate member which, when supplied with a voltage of +7000 volts, has a surface potential above 30 volts at a distance of 15 mm from its surface, and at least one of the electrode plates comprises a nonmetallic plate.

8 Claims, 7 Drawing Figures

ELECTROSTATIC AIR CLEANER

BACKGROUND OF THE INVENTION

The present invention relates to an electrostatic air cleaner and, more particularly, to an air cleaner which is suitable for removing smoke and the like mixed in the air.

An electrostatic air cleaner generally employed in the past is separated into an ionization region for charging positive particles of dust, smoke and so forth mixed in the air and a collector region for adsorbing positively charged particles on a negatively charged plate. The ionization region is formed by a thin wire disposed between opposing metal plates and the thin wire is selected from metals having the property of releasing free ions (+) in quantities when supplied with a voltage, such as tungsten. The metal plates, which surround the thin wire in spaced relation thereto, are formed of a metal having the property of attracting the (+) ions when supplied with a negative voltage. On the other hand, the collector region is usually formed by a series of aluminum plates, and these plates are adapted to be supplied with positive and negative voltages alternately.

The efficiency of the electrostatic air cleaner of this kind is dependent on the degree of ionization in the ionization region and the strength of the attractive force in the collector region. The degree of ionization can be raised through the use of a thin wire having the property of releasing free ions (+) in quantities as referred to above more effective means therefor is to increase the voltage that is applied to the ionization region. Likewise, the attractive force in the collector region can markedly be increased by raising the voltage to be applied thereto other than the selection of the material used. The spacing of the metal plates in the collector region affects the attractive force, which is increased by reducing their spacing.

While, in view of the above, it may appear that the efficiency of the prior art electrostatic air cleaner could easily be improved by raising the voltage applied, there is a limit to the voltage increase owing to such problems as sparking and the generation of ozone that is bad for the health even in small quantities. Therefore, it is necessary that the voltage used be selected sufficiently low not to allow the generation of sparks between the metal plates and the formation of ozone in the collector region.

A method that is now employed for promoting the ionization is to leave a wide space between the tungsten thin wire and the metal plates for the application of a high voltage. At present, however, the voltage cannot be raised above a predetermined value because of preventing the generation of ozone. If ionization were promoted, then the dust collecting and smoke removing efficiency could be increased through using a voltage low enough to prevent spark generation in the collector region.

As described above, the conventional electrostatic air cleaner is low in efficiency on account of the requirement that the voltage be held below a predetermined value for avoiding the generation of sparks and ozone.

Another problem that has been encountered in the past is that the electrode plates forming the ionization region and the collector region must be washed after use for a predetermined period of time, since it is excessively uneconomical to make disposable the electrode plates formed by aluminum or like metal plates. In addition, since nicotine, tar and so forth contained in tobacco smoke adhere to the electrode plates, it is extremely difficult to remove them by ordinary washing.

In view of such problems as mentioned above, the object of the present invention is to provide an electrostatic air cleaner which overcomes the efficiency limitations imposed on the prior art and permits the use of relatively low-priced disposable electrode plates.

After experimental research on the materials of collector plates used in conventional electrostatic air cleaners of the abovesaid type, the present inventor found that plates formed of various nonconductive materials and nonmetallic materials which, contrary to the customary ideas regarding conductive collector plates, have a surface potential equal to or higher than does an aluminum plate may be employed and, based on this finding, he has now completed the present invention.

SUMMARY OF THE INVENTION

In the electrostatic air cleaner of the present invention, positive and negative electrode plates are disposed alternately at predetermined intervals. Each electrode plate is formed by a plate member which, when supplied with a voltage of +7000 volts, has a surface potential higher than 30 volts at a distance of 15 mm from its surface. At least either one of the positive or negative electrode plates is constituted by a nonmetallic plate, by which it is possible to provide an extremely uniform distribution of the surface charge, to prevent the generation of sparks between the electrode plates and to minimize the formation of ozone during application of a high voltage.

Preferably, all the electrode plates are formed by nonmetallic plates and, further, it is preferable that all the negative electrode plates or either one of the positive or negative plates be constituted by porous nonmetallic sheets containing carbon.

More preferably, at least either the positive or negative electrode plate is made nonconductive.

DETAILED DESCRIPTION OF THE INVENTION

Figure 1:
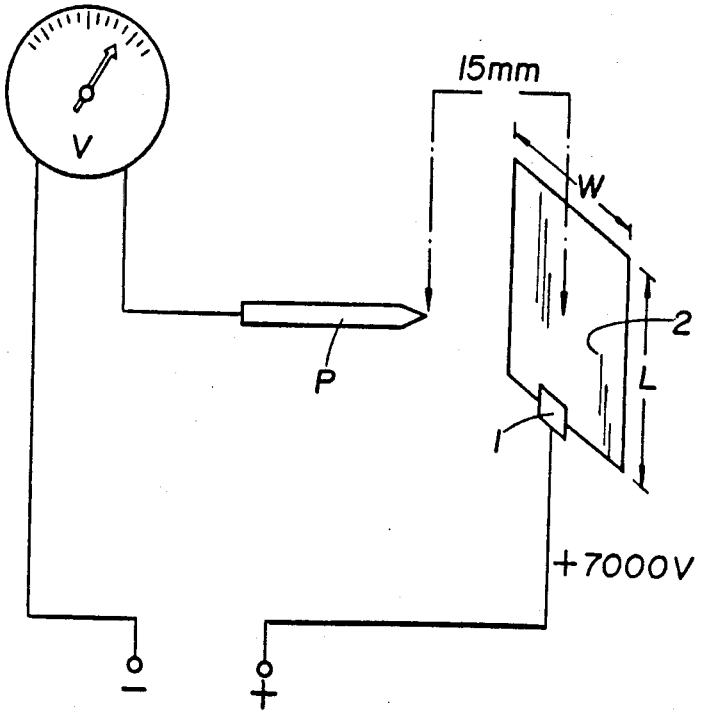
FIG. 1 is a diagram showing a method of measuring the surface potential of an electrode plate.

At first, the present inventor obtained such measured results as shown in the following table I through a method shown in FIG. 1 in which a 30 mm×50 mm sample 2 was held by a terminal clip 1 boosted up to +7000 volts and the surface potential of the sample 2 was measured by bringing a positive probe p of a voltmeter to a position 15 mm distant from the surface of the sample 2.

TABLE I

| Sample | Surface Charge (V) |
|---|---|
| Tungsten thin wire | 100 |
| Aluminum plate | 100 |
| (Plastic) plate of bakelite containing asbestos | 100 |
| (Plastic) plate of bakelite with no inclusions | 30 |
| Acrylic resin plate | 0 |
| Transparent glass plate | 25 |
| Cardboard (brown carton blank) | 50 |
| Cardboard covered with tracing paper (brown carton blank) | 100 |
| *Cardboard containing black carbon coloring agent | 90 |
| Epoxy resin sheet | 0 |
| Heatproof (cement) sheet | 100 |

*The cardboard containing the black carbon coloring agent has a conductivity of about 10 kΩ per centimeter.

Several reasons are considered for which the nonconductive and non-metallic sheet materials shown in Table I have different values of surface potential. One reason is that a certain sheet member, for example asbestos, has in itself the property of readily releasing free ions. That is to say, the asbestos is a compound of magnesium, calcium and silica, and the magnesium and the calcium are very positive (readily releasing positive ions). It is considered as another reason that in the case of a material highly compressed by hardening, the surface potential increases by virtue of the tension of molecular bonds. Moreover, it is considered that an adhesive binder used in the material causes a change in the intermolecular force to raise the surface potential. Paper subjected to a hardening process, for example, high pressure rolling for providing it with a glossy surface, and relatively hard semi-transparent tracing paper exhibited excellent surface potential performance. Besides, a nonmetallic sheet, obtained by sandwiching between sheets of glossy paper or tracing paper inexpensive cardboard, such as is usually employed for a shoe box, a fancy box or the like, exhibits a far higher surface potential value than mere cardboard, glossy paper or tracing paper.

It is desirable that the electrode plates for use in the present invention have as large a surface potential value as possible, and the plate members having a surface potential above 30 volts in Table I permit an increase in the voltage applied thereto because of their nonconductivity, and hence can be used as the electrode plates in the present invention. On the other hand, the plate members having a surface potential below 30 volts are suitable for use as insulating supports rather than as electrode plates.

The measured results given in Table I have revealed that the use of metal plates is not indispensable to the fabrication of electrostatic air cleaner. This means that a higher voltage can be applied without the fear of spark generation, and the surface charges on the nonconductive sheet are distributed uniformly over the entire area of its surface and are not centered on an end or edge portion, unlike in the case of a conductive sheet, so that the formation of ozone is substantially suppressed.

Figure 2:
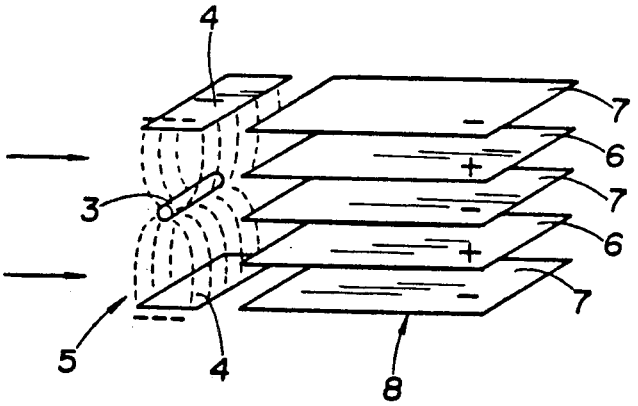
FIG. 2 PRIOR ART
FIG. 2 is a schematic diagram illustrating a cell structure of the conventional electrostatic air cleaner.
Figure 3:
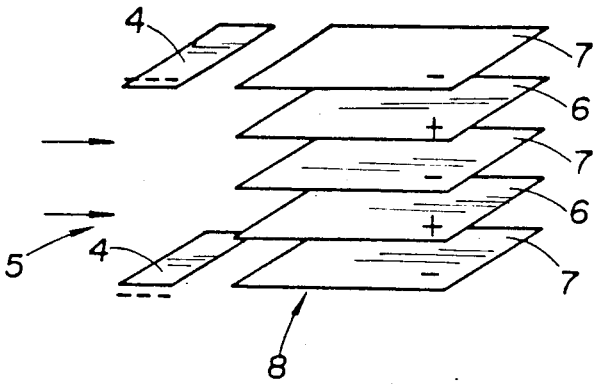
FIG. 3 PRIOR ART
FIG. 3 is a schematic diagram illustrating the cell structure of FIG. 2 with the tungsten thin wire thereof removed.
Figure 4:
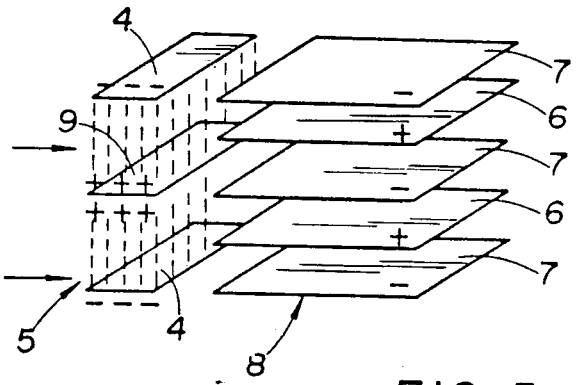
FIG. 4 is a schematic diagram illustrating a cell structure employing a nonmetallic plate in place of the tungsten thin wire used in the cell of FIG. 2.

Next, tests were made for comparison of the performances of a conventional type of electrostatic air cleaner and an electrostatic air cleaner employing the materials shown in Table I. For the tests electrostatic air cleaner cells were made such as shown in FIGS. 2 to 4. The cell depicted in FIG. 2 is a cell of the conventional electrostatic air cleaner, in which electrode plates 4 formed by aluminum plates are disposed on opposite sides of a tungsten thin wire 3 to set up an ionization region 5 and, in adjacent but spaced relation thereto, a series of aluminum plates are disposed as positive and negative electrode groups 6 and 7 alternately with each other, constituting a collector region 8. The cell shown in FIG. 3 is formed with the tungsten thin wire 3 removed from the cell of FIG. 2, and the cell shown in FIG. 4 employs a plate member 9 in place of the tungsten thin wire used in the cell of FIG. 2. The cells thus produced were each placed in a transparent hemispherical dome 15 cm in radius and 15 cm in height, in which a 2 cm long cigarette was burnt to fill the dome with smoke, a small fan in the dome was driven to blow the smoke into the cell, a voltage of 7000 volts was applied and then the time needed for the smoke in the dome to completely disappear was measured using a stopwatch. This measurement was made twice for each cell and the results of the tests are shown in Table II. Incidentally, the electrode plates of the groups 6 and 7 were 8.5×10 cm in size, the number of the plates used was a total of 17 and they were disposed at 5 mm intervals.

TABLE II

| Structure of Cell | Time Required (sec) First | Second |
|---|---|---|
| Conventional cell of FIG. 2 using tungsten thin wire | 2.72 | 3.02 |
| Cell of FIG. 3, with tungsten thin wire removed from the conventional cell | 3.44 | 3.58 |
| Cell of FIG. 4 employing, in place of tungsten thin wire, a bakelite plate containing asbestos | 2.76 | 2.88 |
| Cell of FIG. 4 employing, in place of tungsten thin wire, a plate of black cardboard containing black carbon coloring agent | 3.65 | 3.77 |
| Cell of FIG. 4 employing, in place of tungsten thin wire, a plate of ordinary brown cardboard covered with glossy paper | 2.50 | 2.66 |

The test results given above in Table II indicate that the plate structure having ordinary brown cardboard covered with glossy paper has the propery of giving off far more free ions that does the conventional tungsten or like metal wire. Furthermore, the cell using the black cardboard containing the carbon coloring agent is poor in performance because of the inclusion of the carbon coloring agent; namely, its performance is poorer than that of the cell without the tungsten thin wire. One of the causes of this is that carbon of the black cardboard containing the carbon coloring agent has the property of adsorbing positive ions, and therefore, it is considered that the black cardboard is ideal as a negative electrode plate of the collector region.

The experimental results given above in Tables I and II have revealed not only that metallic members need not be used in the ionization and the collector regions of the electrostatic air cleaner, but also that the use of nonmetallic members improves the performance of the air cleaner.

Moreover, according to the abovesaid experiments in which the nonmetallic member was used, even when the nonmetallic member supplied with a voltage was brought close to a metallic conductor, substantially no sparks were generated and, in fact, even when they were directly contacted with each other, the applied voltage was not short circuited. Only when the metallic conductor was brought so close to the nonmetallic member as to be substantially in contact therewith, very small sparks were observed. This shows that in the electrostatic air cleaner employing the nonmetallic members, the voltage to be applied can be selected higher than in the prior art, providing for heightened dust removing and smoke removing effects. With the conventional metallic member, when the voltage is raised, charges are centered on its edge or end portion to produce therefrom a corona discharge, generating ozone. But, in the case of the nonmetallic member, surface charges by the applied voltage are distributed over the entire area of its surface and are not centered on a particular portion, so that the corona discharge is substantially decreased and consequently, the generation of ozone is suppressed.

Besides, the experimental results shown in Table I show that certain nonmetallic material, for instance, acrylic resin and epoxy resin, do not produce thereon surface charges even if supplied with a high voltage. These materials cannot be used as electrode plates of the electrostatic air cleaner but they are excellent as insulators, and hence are useful as supports or spacers of the electrode plates.

Based on the findings described above, the electrostatic air cleaner of the present invention can be produced through using various nonmetallic members.

First, the following embodiments can be considered in which electrode plates forming the cell of the electrostatic air cleaner of the present invention are all formed by nonmetallic plates:

(A) All the electrode plates of the cell are formed using ordinary brown cardboard.

(B) All the electrode plates of the cell are formed by plates of brown cardboard covered with glossy paper.

(C) The cell is formed by disposing alternately cardboard containing a black carbon coloring agent and plates having brown cardboard covered with glossy paper.

Next, the following embodiments can be considered in which electrode plates forming the cell of the electrostatic air cleaner of the present invention are formed by a combination of metallic and nonmetallic plates:

(D) The cell is formed by disposing alternately aluminum plates and plates of brown cardboard covered with gloss paper.

(E) The cell is formed by disposing alternately aluminum plates and plates of bakelite containing asbestos.

Figure 5:
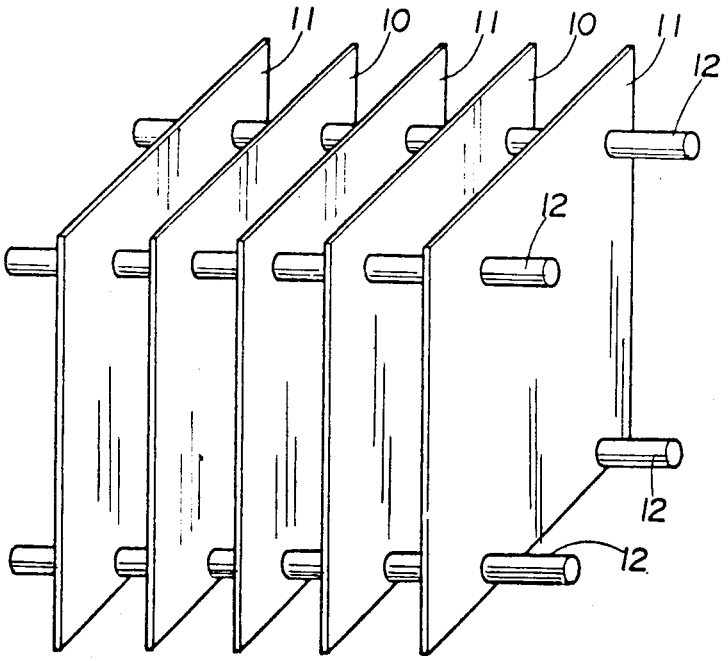
FIG. 5 is a perspective view showing a cell structure according to an embodiment of the present invention.

FIG. 5 illustrates an example of the cell of the electrostatic air cleaner of the present invention through the combined use of the electrode plates mentioned above in (A) to (E). In the cell of the present invention, the ionization region and the collector region need not be constituted separately, unlike in the prior art, and electrode plates 10 to be supplied with a positive voltage and electrode plates 11 to be supplied with a negative voltage are alternately disposed in parallel by means of combination spacer and supporting insulating rods 12.

In the case of forming the cell of a combination of metallic and nonmetallic plates, the negative electrode plates are formed by metallic plates (aluminum plates) and the positive electrode plates are formed by nonmetallic plates.

In the case of the abovesaid embodiment (C) in which the electrode plates of the cell are all constituted by nonmetallic plates, the negative electrode plates are each formed by a plate of cardboard containing a black carbon coloring agent, whereas the positive electrode plates are each formed by a plate of brown cardboard covered with glossy paper. As described previously, the black cardboard colored by carbon has the property of strongly adsorbing positively charged particles, and hence it is not suitable for use as the positive electrode plate but is optimal as the negative electrode plate. In contrast thereto, the plate having brown cardboard covered with glossy paper generates a high surface potential when supplied with a positive voltage, and hence is optimal as the positive electrode plate. The plate produced by covering brown cardboard with glossy paper functions sufficiently as the negative electrode plate, also, but, in such a case, it is observed that its performance is a little poorer than in the case where the aforementioned black cardboard is used as the negative electrode plate.

An example of the structure for holding the positive electrode plates 10 and the negative electrode plates 11 in spaced relation is such as shown in FIG. 5, in which four insulating rods 12, e.g. of acrylic or epoxy resin, are inserted into and fixed in through holes made in the electrode plates 10 and 11 at four corners thereof.

Figure 6:
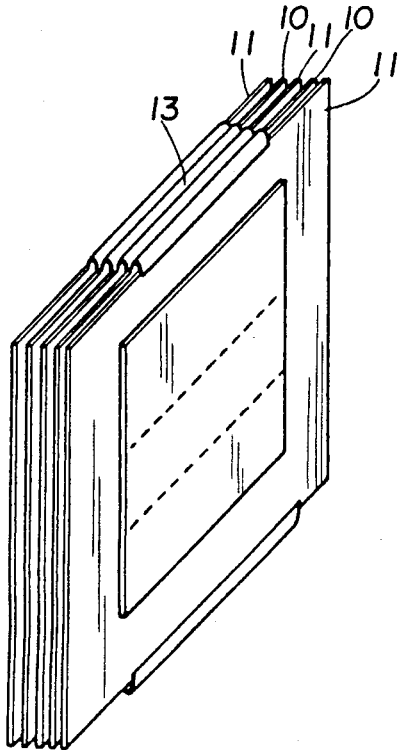
FIGS. 6 and 7 are perspective views illustrating cell structures according to other embodiments of the present invention.
Figure 7:
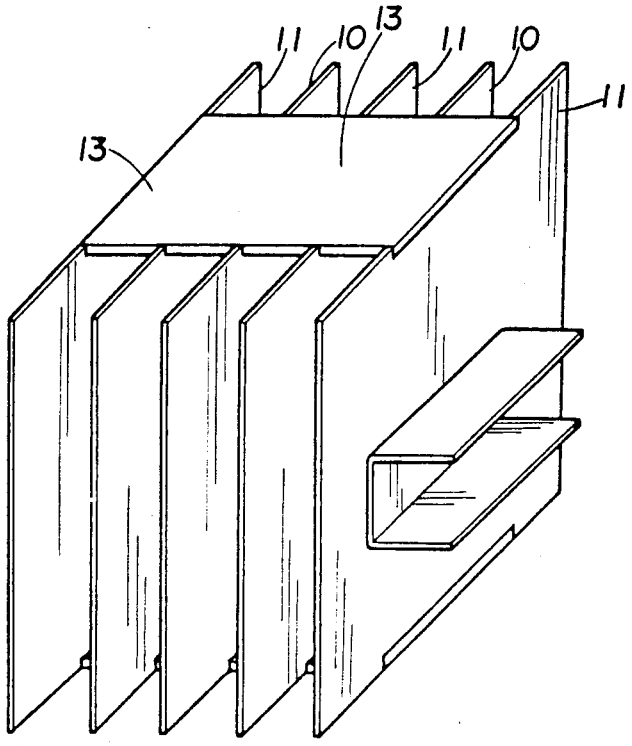

The structure utilizing the abovementioned rods 12 of acrylic resin is relatively bulky but, by using a thin plastic film 13, e.g. of acrylic or epoxy resin, as a positive and negative electrode plate coupling band as shown in FIGS. 6 and 7, it is possible to obtain a collapsible cell structure. That is to say, as shown in FIG. 6, when the cell is collapsed, the coupling band 13 is bent to project out from marginal edges of the electrode plates 10 and 11 and, as shown in FIG. 7, when the cell is spread out by pulling the two outermost electrode plates in opposite directions, the coupling band 13 extends to maintain the electrode plates 10 and 11 at predetermined intervals. Then the cell thus spread out is fixed to a frame, fixedly holding the electrode plates at the predetermined intervals.

As has been described in the foregoing, according to the electrostatic air cleaner of the present invention, since the nonmetallic plate is used as at least one of the positive and negative plates, the distribution of surface charges on the nonmetallic electrode plate is extremely uniform and, consequently, a high voltage can be applied without generating sparks between the electrode plates and with minimum generation of ozone, producing heightened dust and smoke removing effect.

Furthermore, when a porous sheet, such as cardboard or the like, is used as the electrode plate, the smell of a cigarette or the like is appreciably adsorbed into the sheet because it is adsorptive to some extent because of its porosity. Especially, in the case of cardboard containing carbon, the deodorizing function of the carbon is added, producing a marked deodorizing effect.

Moreover, according to the present invention, since it is possible to use, as the electrode plates, very inexpensive nonmetallic plates, such as cardboard and so on, the cell of the electrostatic air cleaner can be made disposable.

In addition, by using a plate of a material having a high surface potential as shown in Table I, the use of the tungsten thin wire for initial ionization becomes unnecessary, making the cell structure very low-priced.

While in the foregoing preferred embodiments of the present invention have been described, various other materials than the aforementioned ones can be employed for the electrode plates. In particular, many kinds of fibrous paper other than the cardboard and laminations of them can be utilized.

I claim:

1. In an electrostatic air cleaner comprising a plurality of positive electrode plates and negative electrode plates arranged alternately at predetermined intervals, and wherein a high voltage is applied across both said positive and negative electrode plates, the improvement wherein:

each said positive electrode plate is formed entirely of a nonconductive nonmetallic material which, when said positive electrode plate is supplied with a voltage of +7000 volts, provides said positive electrode plate with a surface potential above 30 volts at a position spaced 15 mm from a surface of said positive electrode plate; and each said negative electrode plate comprises a plate member formed of a paper material containing carbon.

2. The air cleaner claimed in claim 1, wherein each said positive electrode plate is formed entirely of a cardboard material covered with glossy paper or tracing paper.

3. The air cleaner claimed in claim 1, wherein each said positive electrode plate is formed entirely of a bakelite material containing asbestos.

4. The air cleaner claimed in claim 1, wherein each said positive electrode plate is formed entirely of a sheet of cement.

5. The air cleaner claimed in claim 1, further comprising support means for supporting said positive and negative electrode plates and for maintaining said predetermined intervals therebetween.

6. The air cleaner claimed in claim 5, wherein said support means comprises rod-shaped members extending through said electrode plates.

7. The air cleaner claimed in claim 5, wherein said support means comprises band-shaped members attached to said electrode plates in a manner to be bendable and to permit the assembly of said electrode plates to be collapsible.

8. The air cleaner claimed in claim 5, wherein said support means is made of acrylic or epoxy resin.

* * * * *